US011787449B2

(12) United States Patent
Laflamme

(10) Patent No.: US 11,787,449 B2
(45) Date of Patent: Oct. 17, 2023

(54) FLOOR STRUCTURE OF A RAIL VEHICLE AND METHOD OF MANUFACTURING SUCH FLOOR STRUCTURE

(71) Applicant: Bombardier Transportation GmbH, Berlin (DE)

(72) Inventor: Martin Laflamme, Levis (CA)

(73) Assignee: Bombardier Transportation GmbH, Berlin (DE)

( * ) Notice: Subject to any disclaimer, the term of this patent is extended or adjusted under 35 U.S.C. 154(b) by 175 days.

(21) Appl. No.: 17/193,266

(22) Filed: Mar. 5, 2021

(65) Prior Publication Data

US 2022/0281491 A1 Sep. 8, 2022

(51) Int. Cl.
*B61D 17/10* (2006.01)
*B61F 1/14* (2006.01)

(52) U.S. Cl.
CPC ..... *B61D 17/10* (2013.01); *B61F 1/14* (2013.01)

(58) Field of Classification Search
CPC ..... B61D 17/08; B61D 17/10; B61D 49/00; B61F 1/00; B61F 1/02; B61F 1/04; B61F 1/06; B61F 1/08; B61F 1/12; B61F 1/14
See application file for complete search history.

(56) References Cited

U.S. PATENT DOCUMENTS

| | | | | |
|---|---|---|---|---|
| 2,565,678 | A * | 8/1951 | Dean | B61F 1/06 105/443 |
| 4,930,427 | A * | 6/1990 | Ritter | B61D 17/08 105/407 |
| 5,287,813 | A | 2/1994 | Hänni et al. | |
| 6,978,720 | B2 * | 12/2005 | Johnson | B61D 17/08 105/411 |
| 7,798,753 | B2 * | 9/2010 | Yurgevich | B60P 7/0815 410/115 |
| 10,471,974 | B2 * | 11/2019 | Hirashima | B61D 17/10 |
| 2005/0087096 | A1 * | 4/2005 | Creighton | B61D 45/001 105/355 |
| 2020/0086967 | A1 | 3/2020 | Tiryaki et al. | |

FOREIGN PATENT DOCUMENTS

| | | | | |
|---|---|---|---|---|
| DE | 288130 | A5 | 3/1991 | |
| DE | 20002265 | U1 * | 4/2000 | B61D 17/10 |
| DE | 102010041196 | A1 | 3/2012 | |
| EP | 2570322 | A1 | 3/2013 | |
| EP | 3772443 | A1 * | 2/2021 | B61D 17/10 |

* cited by examiner

*Primary Examiner* — S. Joseph Morano
*Assistant Examiner* — Cheng Lin
(74) *Attorney, Agent, or Firm* — The Webb Law Firm

(57) ABSTRACT

A floor structure of a rail vehicle car body includes a supporting structure having a left and a right longitudinal beams and a plurality of transverse structural members using a low-heat welding process. A floor panel is directly and releasably attached atop the supporting structure using and a plurality of non-permanent, pressure interlocking fasteners.

15 Claims, 3 Drawing Sheets

FLOOR STRUCTURE OF A RAIL VEHICLE AND METHOD OF MANUFACTURING SUCH FLOOR STRUCTURE

BACKGROUND OF THE INVENTION

Field of the Invention

The present invention generally relates to the field of car bodies of rail vehicles. More specifically, the invention relates to a floor structure of a rail vehicles which is removably fixed to a supporting structure.

Description of Related Art

Passenger rail cars are typically designed to last some 40 years. This is however only partially true as the vehicle will normally undergo a major refurbishment around its mid-life when many components will be changed. Passenger floors, especially those of subways, are subjected to heavy wear and are therefore part of the components required to be replaced during the refurbishment process. This however proves to be a work-intensive process since the passenger floor of a vehicle is typically fixed to a supporting structural portion of the railcar body using a thick layer of adhesive. Indeed, not only must the passenger floor be separated from the supporting structure by cutting the adhesive, but any remains of the adhesive must also be removed from the supporting structure in preparation for receiving a new passenger floor.

The main reason why such a thick layer of adhesive is used to fix the passenger floor to the supporting structure of the railcar body is that the supporting structure is not sufficiently flat to directly attach the passenger floor on it. Indeed, the thickness of the adhesive between the supporting structure and the passenger floor varies, allowing the floor to be adequately flat although the supporting structure is not. Welding operations during the manufacturing process of the railcar body cause this unintended deformation in the floor supporting structure.

European Patent no. 2 570 322 to Büttner et al. disclose an alternative solution. In order to compensate for the insufficient flatness of the supporting structure, Büttner teaches attaching the passenger floor to the supporting structure through an intermediate structure mounted on the supporting structure with resilient mounts. Similarly to the varying thickness of adhesive, these resilient mounts are more or less compressed, thereby allowing the passenger floor to be flat while the supporting structure is not. However, because this intermediate structure is more rigid than the floor, the floor needs to be bolted to the intermediate structure. This makes for an expansive alternative.

There is therefore a need to provide a cheaper, more convenient way to install and remove a passenger floor in a railcar vehicle.

SUMMARY OF THE INVENTION

It is an object of the present invention to provide a floor structure for a rail vehicle and a method of manufacturing such a floor structure that overcomes or mitigates one or more disadvantages of known floor structures of rail vehicles, or at least provides a useful alternative.

The invention provides the advantages of providing a floor which may be repeatably installed and removed without leaving residues on a supporting structure of the car body.

In accordance with an embodiment of the present invention, there is provided a floor structure of a rail vehicle car body where the car body is provided with a left and a right sidewalls and where the floor structure comprises a left and a right longitudinal beams, a plurality of transverse structural members, a floor panel and a plurality of fasteners. The left and the right longitudinal beams extend longitudinally along the respective left and right sidewalls of the car body. Each transverse structural member is directly and permanently fixed at its one end to the left longitudinal beam and at its other end to the right longitudinal beam. The transverse structural members extend in a transverse direction of the car body. Each transverse structural member is placed at a predetermined longitudinal distance from each other. Each fastener has a first and a second interlocking halves. Each fastener is of the non-permanent, reclosable, pressure-interlocking type, thereby having the capability of being fastened and unfastened repeatably. Each transverse structural member is provided on its operatively mating surface with one of the first interlocking halves of the plurality of fasteners. These first interlocking halves are positioned at a predetermined transversal distance from the left longitudinal beam. The floor panel is provided on its underside with the second interconnecting halves of the plurality of fasteners. These second interlocking halves are installed, longitudinally, at the predetermined longitudinal distance from each other and, transversely, at the predetermined traversal distance from the left longitudinal beam. By doing so, the position of each second interlocking half corresponds to a position, within the rail car, of its respective interlocking first half installed on the mating surfaces of the transversal structural members. The floor panel is removably, and directly, attached atop the plurality of transverse structural members through interlocking the corresponding first and second halves of each one of the plurality of fasteners.

Optionally, each transverse structural member may be directly fixed to the left and right longitudinal beams using a permanent low-heat joining process such as a laser welding process or a friction-stir welding process, thereby defining a supporting structure having a substantially flat imaginary mounting plane. Advantageously, the mounting plane of this supporting structure may have a flatness tolerance of 3 mm (0.12 inch) per meter (3.28 feet).

Optionally, the floor panel may be made of a plurality of floor panel portions which are each attached to at least two transverse structural members.

Optionally, the plurality of fasteners may be a hook and loop reclosable fastener. The first interlocking half may be either one of the hook and loop while the second interlocking portion is the other of the hook and loop. Alternatively, the first and second interlocking halves may be of the mushroom-shaped head type.

Optionally, each first interlocking half affixed to one of the plurality of transverse structural members may run a majority of a length of the transverse structural member.

Alternatively or complementarily, each transverse structural member may be provided with a plurality of first interlocking halves disposed along a length of the transverse structural member at a predetermined pitch. Similarly, the underside of the floor panel may be provided with second interlocking halves running along a transversal direction of the floor panel at the predetermined pitch so that each second interlocking half may interlock with its corresponding first interlocking half.

Optionally, damping elements may be fixed to each of the plurality of transverse structural members in between the plurality of first interlocking halves disposed along the length of each one of the plurality of transverse structural members.

Advantageously, a sub-floor distance between the underside of the floor panel and a top surface of each one of the plurality of transverse structural members may be less than a thickness of the floor panel itself. This sub-floor distance may be substantially that of a thickness of one interlocked fastener which is typically less than 10 mm (0.39 inch).

Optionally, the floor structure may further comprise a left and a right baseboards attached respectively to the left and the right sidewalls at a junction of the floor panel and of the respective sidewall. The baseboards are operative to vertically lock the floor panel in place.

In accordance with another embodiment of the present invention, there is provided a rail vehicle integrating the floor structure described above.

In accordance with another embodiment of the present invention, there is provided a method of manufacturing a floor structure for a rail car having a left and a right sidewalls. The method comprises

- placing a left and a right longitudinal beams parallel to each other;
- positioning a plurality of transverse structural members between the left and the right longitudinal beams and parallel to each other at a predetermined longitudinal distance from each other;
- joining directly and separately each one of the plurality of transverse structural members to the left and to the right longitudinal beams so as to create a supporting structure having a substantially flat imaginary mounting plane;
- fixing at least one first interlocking half of each one of a plurality of fasteners to each transverse structural member at a predetermined transversal distance from the left longitudinal beam;
- fixing to an underside of a floor panel a plurality of second interlocking halves of each one of the plurality of fasteners at the predetermined longitudinal distance from each other; and
- attaching the floor panel to the plurality of transverse structural members by interlocking each one of the first interlocking halves of the plurality of fasteners to a corresponding one of the second interlocking halves of the plurality of fasteners.

Optionally, the joining may further comprise using a low-heat joining process selected from the list consisting of laser welding and friction-stir welding. Advantageously, this using of a low-heat joining produces the imaginary mounting plane of the supporting structure with a flatness tolerance within 3 mm (0.12 inch) per meter (3.28 feet).

Optionally, the attaching may further comprise interlocking together two compatible mushroom-head type of interlocking halves.

Optionally, the attaching may further comprise locating the floor panel at a sub-floor distance defined between the floor panel and each one of the plurality of transverse structural members that is less than a thickness of the floor panel. Advantageously, this sub-floor distance may substantially correspond to a thickness of one interlocked fastener.

BRIEF DESCRIPTION OF THE DRAWINGS

These and other features of the present invention will become more apparent from the following description in which reference is made to the appended drawings wherein.

DETAILED DESCRIPTION OF THE INVENTION

The present invention relates to a floor structure for a rail car where the floor structure may be easily installed and then removed when damaged and which has a low profile.

Figure 1:
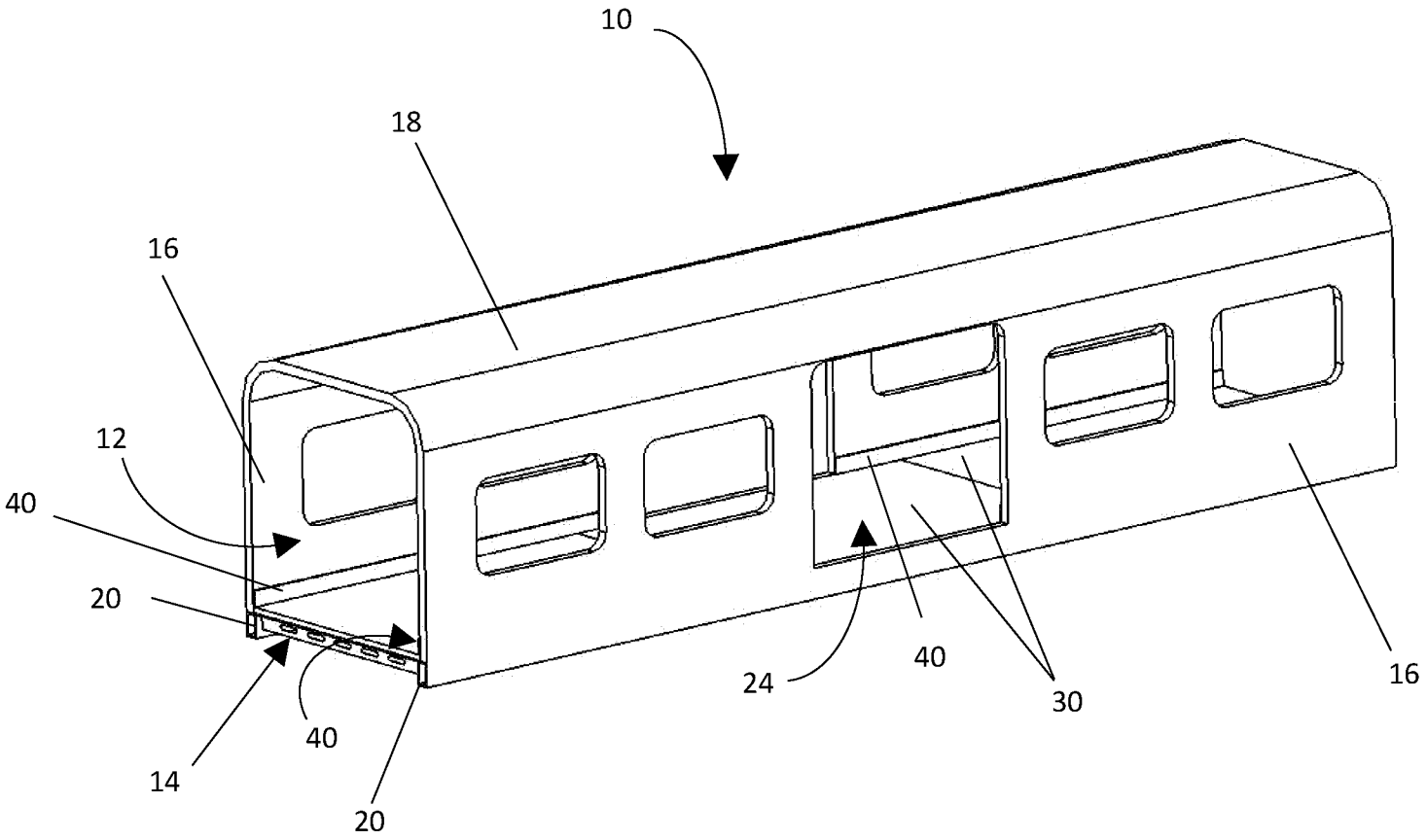
FIG. 1 is an isometric view of a rail car body in accordance with an embodiment of the present invention.

FIG. 1 depicts a car body 10 of a rail vehicle. So that a clear view of a passenger compartment 12 of the car body 10 is possible, end walls of the car body 10 are not shown. The car body 10 is made of a floor structure 14, left and right sidewalls 16, end walls (not shown) and a roof 18.

Figure 2:
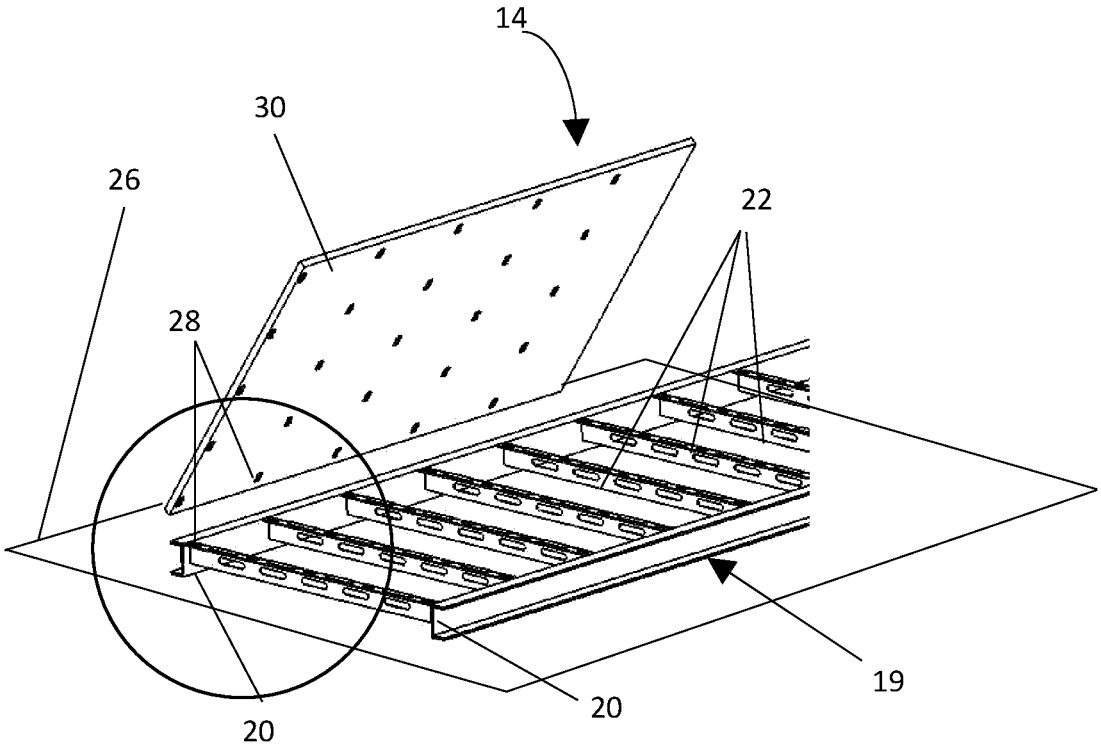
FIG. 2 is an isometric view of a floor structure of the rail car body of FIG. 1.

Details of the floor structure 14 are shown in FIG. 2, now concurrently referred to. A supporting structure 19 of the floor structure 14 comprises two longitudinal beams 20, one along the left sidewall 16 of the car body and one along a right sidewall 16, as well as a plurality of transverse structural members 22. The transverse structural members 22 are directly and permanently fixed at their extremities to a different one of the left and right longitudinal beams 20. Although the transverse structural members 22 are depicted as extending transversally to the car body 10, they could extend at an angle other than 90 degrees to the longitudinal beams 20. Each transverse structural member 22 is placed along the longitudinal beams 20 at a predetermined longitudinal distance from each other. This longitudinal distance may be constant or may vary (constant or variable pitch) along a length of the rail car body 10. The longitudinal beams 20 and the transverse structural members 22 are typically either all made of steel or all made of aluminum.

The transverse structural members 22 are fixed to both longitudinal beams using a low-heat welding process such as a laser welding process or a friction-stir welding process. These low-heat generating welding processes, which may be automated, advantageously only produce low to no deformation in the welded supporting structure 19. At least, these low-heat generating welding processes produce less deformation in the welded supporting structure than conventional welding processes, such as TIG or MIG welding, producing more heat. Consequently, a mounting plane 26 of the supporting structure 19 may be produced with a flatness tolerance within 3 mm (0.12 inch) per meter (3.28 feet). This level of flatness is important for the floor 24 to be directly mounted to the supporting structure 19 using fasteners 28 as will be further described below. In this context, directly means that the floor 24 is mounted to the supporting structure 19 solely through the fasteners 28 and that no other intermediate mounting structure, especially of the resilient type, is used.

The floor 24 is typically made of a sandwich construction where two skins are placed on each side of a core. The skins may be made of a metallic material or of laminated fiber-reinforced type of material bonded to the core. To cover the whole surface of the supporting structure 19, the floor 24 may be made of one or more floor panels 30. In other words, one or more floor panels 30 may make up the whole floor 24. Typically, and as shown in the present example, the floor 24 is made of many floor panels 30. Each floor panel 30 is attached to at least two transverse structural members 22. In the case where more than one floor panel 30 are used, these floor panels 30 are juxtaposed to each other and a sealant may be used at their junction to prevent air or water infiltrations, or from other environmental element.

Figure 3:
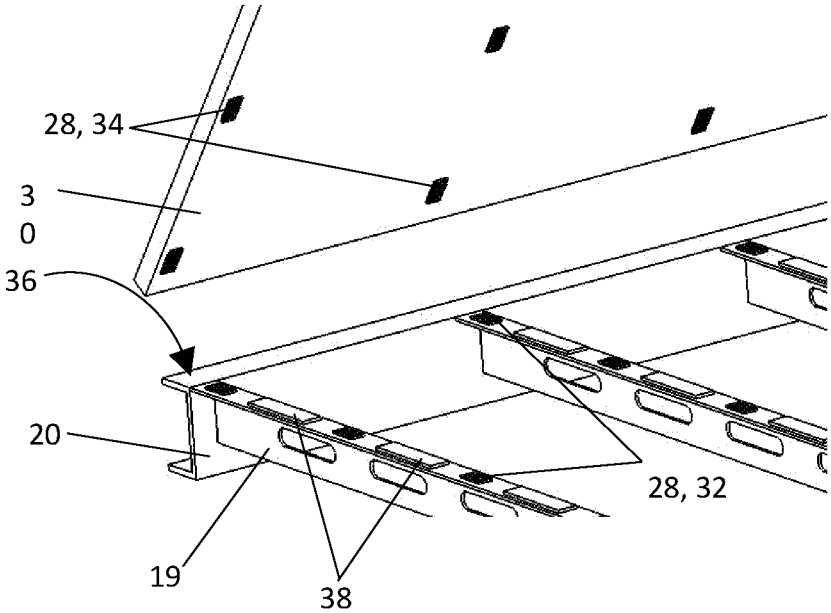
FIG. 3 is a detailed view of a portion of FIG. 2.
Figure 4:
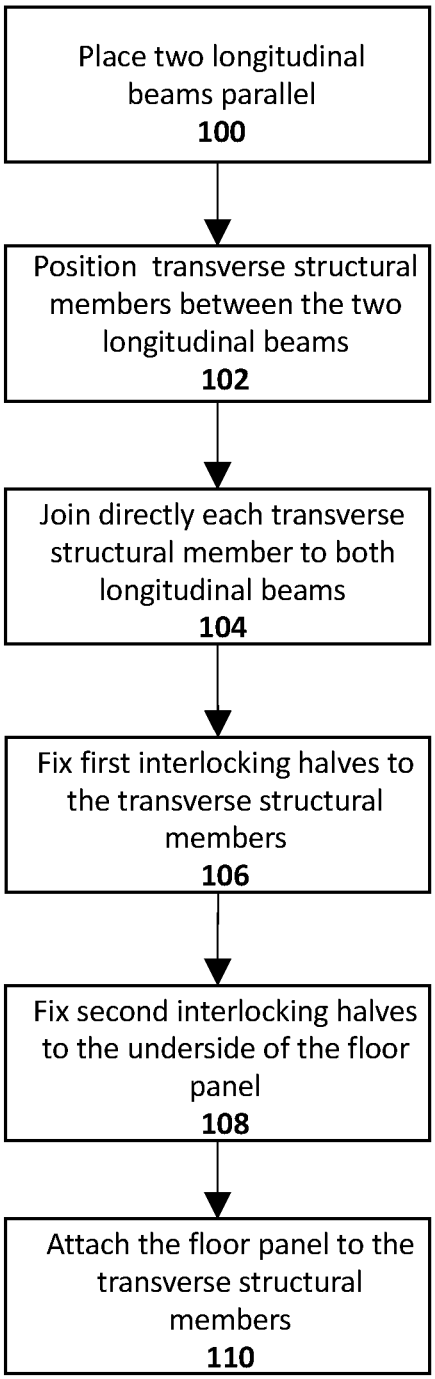
FIG. 4 is a schematic of a method of manufacturing the floor structure shown in FIG. 2 in accordance with another embodiment of the present invention.

FIG. 3, showing a close-up of a portion of FIG. 2, is now concurrently referred to. The fasteners 28 are of the non-permanent, releasable and reclosable type. The fasteners 28 thereby have the capability of being closed, opened, and reclosed repeatably without damaging either themselves or the fastened components, in the present case the floor 24 (or floor panels 30) and the supporting structure 19 and more precisely the transverse structural members 22 and optionally also the longitudinal beams 20. The fasteners 28 are therefore used to attach directly the floor 24 to the supporting structure 19. The fasteners 28 are made of two interlocking halves which can be referred to as a first and second interlocking halves, or male/female interlocking halves, or other appropriate reference for the type of fastener used. In the present example, the interlocking halves will be referenced to as the first interlocking half 32 and the second interlocking half 34. Preferably, the fasteners 28 are of the type which are interlocked using pressure. For example, such pressure interlocked fasteners may be a pressure/snap button/fastener or a reclosable fastener such as a Velcro® hook and loop fastener or a 3M™ Dual Lock™ reclosable fastener having a mushroom-shaped head interface. In the first example, the first interlocking half 32 could be a male portion of the snap button while the second interlocking half 34 could be the female portion of the snap button, or vice-versa. Similarly, the first interlocking half 32 may be either a hook portion of a hook and loop fasteners while the second interlocking portion 34 may be the loop portion, or vice versa. In the case of a reclosable fastener such as the 3M™ Dual Lock™ reclosable fastener, both the first interlocking half 32 and the second interlocking half 34 are similar in that they are made of similar strips of mushroom-shaped heads. For the present application, it has been found that the use of 3M™ Dual Lock™ reclosable fastener performs adequately. In the present description, the term non-permanent is understood to mean that the fasteners 28 are designed to be non-destructively releasable. Hence, the fasteners 28 allow the floor panels 30 to be detached from the supporting structure 19 without damaging neither of the fasteners 28, the floor panels 30 nor the supporting structure 19. This is in opposition to the use of rivets or an of adhesive, for example, in the role of the fastener where at least the fastener and possibly at least one of the floor panels 30 and the supporting structure 19 would get damaged when trying to remove the floor 24 from the supporting structure 19.

Each transverse structural member 22, and optionally also each longitudinal beam 20, is provided on its operatively mating surface 36 with at least one first interlocking half 32. The first interlocking halves affixed to transverse structural members may run a majority of a length of the transverse structural member. Alternatively, and as depicted in FIGS. 2 and 3, many shorter first interlocking halves 32 may be disposed along the length of the transverse structural members at a predetermined distance from either the left or the right longitudinal beams 20, or at a predetermined pitch.

The mating surface 36 corresponds to the physical surfaces on which the first interlocking halves are fixed. The mounting plane 26 is a flat plane representing the plane on which the floor 24 would rest when mounted on the supporting structure 19 which may be distorted due to its manufacturing process. This distortion must be kept under a certain limit so that the mounting plane 26 lies within an acceptable flatness tolerance of the mating surface 36. If the supporting structure 26 is manufactured without any distortion, then the mounting plane 26 and the mating surface 36 are coplanar.

Each floor panel 30 making up the floor 24 is provided on its underside with second interconnecting halves 34 of the fasteners, corresponding to the installed first interconnecting halves 32 installed on the supporting structure 19. These second interlocking halves 34 are installed, in the longitudinal direction of the car body 10, at the same predetermined longitudinal distance from each other than those of the first interlocking halves 32. Similarly, the second interlocking halves 34 are installed, in the transverse direction of the car body 10, at the predetermined traversal distance from a reference point such as the left or the right longitudinal beam 20. By doing so, the longitudinal and lateral position of each second interlocking half 34 corresponds to a position, within the rail car, of its respective first interlocking half 32 installed on the mating surfaces 36 of the transversal structural members 22, and of the longitudinal beams 20 if so equipped. The floor panels 30 may therefore be directly and removably or releasably attached atop the supporting structure 19 through interlocking the corresponding first and second interlocking halves 32, 34 of each fastener 28.

Because the floor panels 30 are directly attached to the supporting structure 19 via the fasteners 28, a sub-floor distance between the underside of the floor panels 30 and a top surface of the transverse structural members 22 may be kept very small, essentially that of one fastened fastener 28. This sub-floor distance may be typically less than 20 mm (0.79 inch), even less than 10 mm (0.39 inch). This sub-floor distance may therefore be less than a thickness of one floor panel 30, which is typically 25.4 mm (1 inch) or more.

In order to damp vibrations, damping elements 38 may be fixed to at least some of the transverse structural members 22 in between the first interlocking halves 32 disposed along the length of the transverse structural members 22. These damping elements 38 are typically made of a resilient material having vibration-absorbing properties.

As best shown in FIG. 1, baseboards 40 may be installed at the junction of each sidewalls 16 with the one or more floor panel 30. Further to the fasteners 28, these baseboards 40 contribute to further vertically retain the floor panel 30 in place against the supporting structure 19.

The floor structure 14 may be manufactured by using the following method:

- first, place 100 the left and the right longitudinal beams 20 parallel to each other so as to be aligned with the left and right sidewalls 16 of the rail car body 10;
- then, position 102 a plurality of the transverse structural members 22 between the left and the right longitudinal beams 20 and parallel to each other at the predetermined longitudinal distance from each other;
- then, assemble the supporting structure 19 by joining 104 directly and separately each transverse structural members 22 to the left and to the right longitudinal beams 20. By doing so, a substantially flat mounting plane of the supporting structure 19 is created. Optionally, a low-heat joining process such as laser welding or friction-stir welding may be used for this joining operation. Advantageously, this using of a low-heat joining process shall yield a flatness of the mounting plane 26 of the supporting structure 19 within an acceptable range, for example 5 mm;
- then, install 106 at least one first interlocking half 32 of each fastener 28 used to each transverse structural member 22. The at least one first interlocking half 32 should be installed at the predetermined transversal distance from a reference point such as the left longitudinal beam 20;

then, install 108 to an underside of the one or more floor panel 30 the second interlocking halves 34 of each fastener 28 used at the predetermined longitudinal distance from each other; and finally, attaching the one or more floor panel 30 to the supporting structure 19, and more precisely to the transverse structural members 22 by interlocking each one of the first interlocking halves 32 to a corresponding one of the second interlocking halves 34 for each fastener 28. Optionally, this step may comprise using reclosable fasteners 28 so that the interlocking step comprises interlocking a first component of the fastener 28 such as a mushroom-head shaped strip or a hook strip with a corresponding second component of the fastener such as a second mushroom-head strip or a loop strip.

Optionally the method of manufacturing the floor structure 14 may further comprise installing the damping elements 38 on the transverse structural members 22 beside the first interlocking half 32 fixed to the transverse structural members 22.

A further option may be that the attaching step may comprise locating the one or more floor panel 30 at the sub-floor distance which is less than the thickness of the floor panel 30.

The present invention has been described with regard to preferred embodiments. The description as much as the drawings were intended to help the understanding of the invention, rather than to limit its scope. It will be apparent to one skilled in the art that various modifications may be made to the invention without departing from the scope of the invention as described herein, and such modifications are intended to be covered by the present description. The invention is defined by the claims that follow.

What is claimed is:

1. A floor structure of a rail vehicle car body having a left and a right sidewalls, the floor structure comprising:

a left longitudinal beam and a right longitudinal beam, the left and the right longitudinal beams extending longitudinally along the respective left and right sidewalls of the car body;

a plurality of fasteners, the plurality of fasteners being of the non-permanent, reclosable, pressure-interlocking type, each fastener having a first and a second interlocking halves;

a plurality of transverse structural members, each transverse structural member being directly and permanently fixed at an end thereof to the left longitudinal beam and at an opposite end thereof to the right longitudinal beam, the transverse structural members extending in a transverse direction of the car body, each transverse structural member being placed at a predetermined longitudinal distance from each other, each transverse structural member being provided on an operatively mating surface with one of the first interlocking halves of the plurality of fasteners at a predetermined transversal distance from the left longitudinal beam; and a floor panel, the floor panel being provided on an underside thereof with the second interconnecting halves of the plurality of fasteners, the second interlocking halves being longitudinally installed at the predetermined longitudinal distance from each other and transversely installed at the predetermined transversal distance from the left longitudinal beam so as to correspond to a position within the rail car of their respective first interlocking half of the plurality of fasteners, the floor panel being removably and directly attached atop the plurality of transverse structural members through interlocking the corresponding first and second interlocking halves of each one of the plurality of fasteners, wherein each transverse structural member is provided with a plurality of first interlocking halves disposed along a length of the transverse structural member at a predetermined pitch, and wherein the floor panel is provided with second interlocking halves running along a transversal direction of the floor panel at the predetermined pitch so as to interlock with their corresponding first interlocking half, and wherein the floor structure further comprises damping elements fixed to at least some of the plurality of transverse structural members in between the plurality of first interlocking halves disposed along the length of said at least some of the plurality of transverse structural members.

2. The floor structure of claim 1, wherein each transverse structural member is directly fixed to the left and right longitudinal beams using a permanent low-heat joining process selected from the list consisting of a laser welding process and a friction-stir welding process, thereby defining a supporting structure having a substantially flat mounting plane.

3. The floor structure of claim 2, wherein a flatness tolerance of the mounting plane is within 3 mm (0.12 inch) per meter (3.28 feet).

4. The floor structure of claim 1, wherein the floor panel is made of a plurality of floor panel portions, each floor panel portion being attached to at least two transverse structural members.

5. The floor structure of claim 1, wherein said further comprising damping elements are fixed to each of the plurality of transverse structural members in between the plurality of first interlocking halves disposed along the length of each one of the plurality of transverse structural members.

6. The floor structure of claim 1, wherein a sub-floor distance between the floor panel and each one of the plurality of transverse structural members is less than a thickness of the floor panel.

7. The floor structure of claim 1, wherein a sub-floor distance between the floor panel and each one of the plurality of transverse structural members is substantially that of a thickness of one interlocked fastener.

8. The floor structure of claim 1, wherein a sub-floor distance is less than 10 mm (0.39 inch).

9. The floor structure of claim 1, further comprising a left and a right baseboards attached respectively to the left and the right sidewalls at a junction of the floor panel and of the respective sidewall, the baseboards being operative to vertically lock the floor panel in place.

10. A rail vehicle having the floor structure of claim 1.

11. A method of manufacturing a floor structure for a rail car having a left and a right sidewalls, the method comprising placing a left and a right longitudinal beams parallel to each other;

positioning a plurality of transverse structural members between the left and the right longitudinal beams and parallel to each other at a predetermined longitudinal distance from each other;

joining directly and separately each one of the plurality of transverse structural members to the left and to the right longitudinal beams so as to create a supporting structure having a substantially flat mounting plane;

fixing at least one first interlocking half of each one of a plurality of fasteners to each transverse structural member at a predetermined transversal distance from the left longitudinal beam;

fixing to an underside of a floor panel a plurality of second interlocking halves of each one of the plurality of fasteners at the predetermined longitudinal distance from each other;

attaching the floor panel to the plurality of transverse structural members by removably interlocking each one of the first interlocking halves of the plurality of fasteners to a corresponding one of the second interlocking halves of the plurality of fasteners; and installing damping elements on at least some of the transverse structural members beside the at least one interlocking half fixed to each one of the plurality of transverse structural members.

12. The method of claim 11, wherein the joining further comprises using a low-heat joining process selected from the list consisting of laser welding and friction-stir welding.

13. The method of claim 12, wherein the joining further comprises producing the mounting plane with a flatness tolerance within 3 mm (0.12 inch) per meter (3.28 feet).

14. The method of claim 11, wherein installing damping elements includes installing damping elements on the transverse structural members beside the at least one interlocking half fixed to each one of the plurality of transverse structural members.

15. The method of claim 11, wherein the attaching further comprises locating the floor panel at a sub-floor distance between the floor panel and each one of the plurality of transverse structural members substantially that of a thickness of one interlocked fastener and less than a thickness of the floor panel.

* * * * *